US007712737B2

(12) United States Patent
Elliot

(10) Patent No.: US 7,712,737 B2
(45) Date of Patent: May 11, 2010

(54) GAIN-SCHEDULED FEEDBACK DOCUMENT HANDLING CONTROL SYSTEM

(75) Inventor: Jack Gaynor Elliot, Penfield, NY (US)

(73) Assignee: Xerox Corporation, Norwalk, CT (US)

( * ) Notice: Subject to any disclaimer, the term of this patent is extended or adjusted under 35 U.S.C. 154(b) by 435 days.

(21) Appl. No.: 11/567,287

(22) Filed: Dec. 6, 2006

(65) Prior Publication Data

US 2008/0136092 A1 Jun. 12, 2008

(51) Int. Cl.
*B65H 9/00* (2006.01)
*B65H 7/02* (2006.01)

(52) U.S. Cl. ..... 271/228; 271/226; 271/227

(58) Field of Classification Search ..... 271/226–228; 700/128

See application file for complete search history.

(56) References Cited

U.S. PATENT DOCUMENTS

| | | | | |
|---|---|---|---|---|
| 4,438,917 | A * | 3/1984 | Janssen et al. | 271/227 |
| 4,855,607 | A * | 8/1989 | Eckl | 250/557 |
| 4,971,304 | A | 11/1990 | Lofthus | |
| 5,078,384 | A * | 1/1992 | Moore | 271/228 |
| 5,169,140 | A * | 12/1992 | Wenthe, Jr. | 271/228 |
| 5,676,477 | A * | 10/1997 | Tanaka et al. | 400/579 |
| 5,678,159 | A | 10/1997 | Williams et al. | |
| 5,715,514 | A * | 2/1998 | Williams et al. | 399/395 |
| 5,887,996 | A | 3/1999 | Castelli et al. | |
| RE37,007 | E * | 1/2001 | Gerlier | 250/548 |
| 6,578,844 | B2 * | 6/2003 | Acquaviva et al. | 271/228 |
| 6,634,521 | B1 * | 10/2003 | Hwang | 221/228 |
| 6,637,634 | B1 * | 10/2003 | Yeo et al. | 226/42 |
| 6,676,123 | B2 * | 1/2004 | Sahlmann | 271/227 |
| 7,422,210 | B2 * | 9/2008 | Dejong et al. | 271/228 |
| 2002/0017755 | A1 * | 2/2002 | Dobberstein et al. | 271/227 |
| 2002/0145249 | A1 * | 10/2002 | Acquaviva et al. | 271/228 |
| 2005/0263958 | A1 | 12/2005 | Knierim et al. | |
| 2006/0163801 | A1 * | 7/2006 | Dejong et al. | 271/227 |
| 2006/0208416 | A1 * | 9/2006 | Dejong et al. | 271/228 |
| 2006/0239733 | A1 | 10/2006 | Choi et al. | |
| 2007/0023994 | A1 * | 2/2007 | Mandel et al. | 271/226 |
| 2007/0296141 | A1 * | 12/2007 | Inoue | 271/226 |
| 2008/0006992 | A1 * | 1/2008 | Inoue | 271/228 |

FOREIGN PATENT DOCUMENTS

EP 0113826 A1 7/1984

* cited by examiner

*Primary Examiner*—Patrick Mackey
*Assistant Examiner*—Patrick Cicchino
(74) *Attorney, Agent, or Firm*—Pepper Hamilton LLP

(57) ABSTRACT

Methods and systems for performing sheet registration are described. A device having a plurality of drive rolls may receive a sheet. Each drive roll may operate with an associated angular velocity. A state vector, including a plurality of state variables, may be identified. Error-space state feedback values may be determined based on a difference between each state variable and a corresponding reference state variable based on a desired sheet trajectory. Control input variable values may be determined based on the error-space feedback values and one or more gains. A motor control signal for a motor for each drive roll may be determined based on the control input variable values and the state variables. Each motor control signal may impart a desired angular velocity for at least one drive roll. The identifying step and each determining step may be performed repeatedly to register the sheet to the desired trajectory.

18 Claims, 16 Drawing Sheets

GAIN-SCHEDULED FEEDBACK DOCUMENT HANDLING CONTROL SYSTEM

BACKGROUND

1. Technical Field

The disclosed embodiments generally pertain to sheet registration systems and methods for operating such systems. Specifically, the disclosed embodiments pertain to methods and systems for registering sheets using a gain-scheduled feedback control scheme based on the pseudo-linearized system.

2. Background

Sheet registration systems are presently employed to align sheets in a device. For example, high-speed printing devices typically include a sheet registration system to align paper sheets as they are transported from the storage tray to the printing area.

Sheet registration systems typically use sensors to detect a location of a sheet at various points during its transport. Sensors are often used to detect a leading edge of the sheet and/or a side of the sheet to determine the orientation of the sheet as it passes over the sensors. Based on the information retrieved from the sensors, the angular velocity of one or more nips can be modified to correct the alignment of the sheet.

A nip is formed by the squeezing together of two rolls, typically an idler roll and drive roll, thereby creating a rotating device used to propel a sheet in a process direction by its passing between the rolls. An active nip is a nip rotated by a motor that can cause the nip to rotate at a variable nip velocity. Typically, a sheet registration system includes at least two active nips having separate motors. As such, by altering the angular velocities at which the two active nips are rotated, the sheet registration system may register (orient) a sheet that is sensed by the sensors to be misaligned.

Numerous sheet registration systems have been developed. For example, the sheet registration system described in U.S. Pat. No. 4,971,304 to Lofthus, which is incorporated herein by reference in its entirety, describes a system incorporating an array of sensors and two active nips. The active sheet registration system provides deskewing and registration of sheets along a process path having an X, Y and θ coordinate system. Sheet drivers are independently controllable to selectively provide differential and non-differential driving of the sheet in accordance with the position of the sheet as sensed by the array of sensors. The sheet is driven non-differentially until the initial random skew is measured. The sheet is then driven differentially to correct the measured skew and to induce a known skew. The sheet is then driven non-differentially until a side edge is detected, whereupon the sheet is driven differentially to compensate for the known skew. Upon final deskewing, the sheet is driven non-differentially outwardly from the deskewing and registration arrangement.

A second sheet registration system is described in U.S. Pat. No. 5,678,159 to Williams et al., which is incorporated herein by reference in its entirety. U.S. Pat. No. 5,678,159 describes a deskewing and registering device for an electrophotographic printing machine. A single set of sensors determines the position and skew of a sheet in a paper process path and generates signals indicative thereof. A pair of independently driven nips forwards the sheet to a registration position in skew and at the proper time based on signals from a controller which interprets the position signals and generates the motor control signals. An additional set of sensors can be used at the registration position to provide feedback for updating the control signals as rolls wear or different substrates having different coefficients of friction are used.

In addition, U.S. Pat. No. 5,887,996 to Castelli et al., which is incorporated herein by reference in its entirety, describes an electrophotographic printing machine having a device for registering and deskewing a sheet along a paper process path including a single sensor located along an edge of the paper process path. The sensor is used to sense a position of a sheet in the paper path and to generate a signal indicative thereof. A pair of independently driven nips is located in the paper path for forwarding a sheet therealong. A controller receives signals from the sensor and generates motor control drive signals for the pair of independently driven nips. The drive signals are used to deskew and register a sheet at a registration position in the paper path.

FIGS. 1A and 1B depict an exemplary sheet registration device according to the known art. The sheet registration device 100 includes two nips 105, 110 which are independently driven by corresponding motors 115, 120. The resulting 2-actuator device embodies a simple registration device that enables sheet registration having three degrees of freedom. The under-actuated (i.e., fewer actuators than degrees of freedom) nature makes the registration device 100 a nonholonomic and nonlinear system that cannot be controlled directly with conventional linear techniques. The control for such a system, and indeed for each of the above described systems, employs open-loop (feed-forward) motion planning.

FIG. 2 depicts an exemplary open-loop motion planning control process according to the known art. One or more sensors, such as PE2, CCD1 and CCD2 shown in FIG. 1B, are used to determine the input (initial) sheet position 125 when the lead edge of the sheet is first detected by PE2 (as represented in FIG. 1B). Note the sheet position, as described, includes the process (the direction that the sheet is intended to be directed), lateral (cross-process), and skew (orientation) degrees of freedom for the sheet. An open-loop motion planner 205 interprets the information retrieved from the sensors as the input position and calculates a set of desired velocity profiles $\omega_d$ that will steer the sheet along a viable path to the final registered position if perfectly tracked (i.e., assuming that no slippage or other errors occur). One or more motor controllers 210 are used to control the desired velocities $\omega_d$. The one or more motor controllers 210 generate motor control signals $u_m$ for the motors 115, 120. The motor control signals $u_m$ determine the angular velocities ω at which each corresponding nip 105, 110 is rotated. For example, a pulse width modulated voltage can be created for a DC brushless servo motor based on $u_{m1}$ to track a desired velocity $\omega_1$. Alternately, any of a stepper motor, an AC servo motor, a DC brush servo motor, and other motors known to those of ordinary skill in the art can be used. The sheet velocity at each nip 105, 110 is computed as the radius (c) of the drive roll multiplied by the angular velocity of the roll ($\omega_1$ for 105 and $\omega_2$ for 110). By matching the angular velocities of the nips 105, 110 to $\omega_d$, sheet registration can be achieved.

Although the sheet is not monitored for path conformance during the process, an additional set of sensors, such as PEL, CCDL and CCD1 in FIG. 1B, can be placed at the end of the registration system 100 to provide a snapshot of the output (final) sheet position to update the motion planning algorithm based on a learning algorithm. However, because path conformance is not monitored, error conditions that occur in an open-loop system may result in errors in the output sheet position that require multiple sheets to correct. In addition, although learning can be used to remove repetitive and slow-changing sources of error, the open-loop nature of the underlying motion planning remains vulnerable to non-repetitive and fast-changing sources of error. Accordingly, the sheet registration system may improperly register the sheet due to slippage or other errors in the system.

Systems and methods for improving the registration of misaligned sheets in a sheet registration system, for using feedback control of a pseudo-linearized system in a sheet registration system, and/or for scheduling gain in a sheet registration system to control the resulting nip forces and sheet tail wag within design constraints while converging the sheet to a desired trajectory within a pre-determined time would be desirable.

SUMMARY

Before the present methods are described, it is to be understood that this invention is not limited to the particular systems, methodologies or protocols described, as these may vary. It is also to be understood that the terminology used herein is for the purpose of describing particular embodiments only, and is not intended to limit the scope of the present disclosure which will be limited only by the appended claims.

It must be noted that as used herein and in the appended claims, the singular forms "a," "an," and "the" include plural reference unless the context clearly dictates otherwise. Thus, for example, reference to a "document" is a reference to one or more documents and equivalents thereof known to those skilled in the art, and so forth. Unless defined otherwise, all technical and scientific terms used herein have the same meanings as commonly understood by one of ordinary skill in the art. As used herein, the term "comprising" means "including, but not limited to."

In an embodiment, a method of performing sheet registration may include receiving a sheet by a device having a plurality of drive rolls, each operating with an associated angular velocity, identifying a state vector including a plurality of state variables, determining error-space state feedback values based on a difference between each state variable and a corresponding reference state variable based on a desired sheet trajectory, determining control input variable values based on the error-space state feedback values and one or more gains, and determining a motor control signal for a motor for each drive roll that imparts a desired angular velocity for at least one drive roll based on the control input variable values and the state variables, and performing the identifying step and each determining step a plurality of times whereby the sheet is registered to the desired trajectory.

In an embodiment, a system for performing sheet registration may include one or more sensors, a plurality of drive rolls, a plurality of motors, and a processor. Each motor may be associated with at least one drive roll. The processor may include a state determination module for identifying a state vector, including a plurality of state variables, for a sheet, an observer module for determining error-space state feedback values based on a difference between each state variable and a corresponding reference state variable based on a desired sheet trajectory, a drive roll velocity determination module for determining desired velocity values for each drive roll based on the error-space state feedback values and one or more gain values, and a motor controller for determining a motor control signal for each motor. Each motor control signal may impart a desired angular velocity for at least one drive roll.

BRIEF DESCRIPTION OF THE DRAWINGS

Aspects, features, benefits and advantages of the present invention will be apparent with regard to the following description and accompanying drawings, of which.

DETAILED DESCRIPTION

Figure 1A:
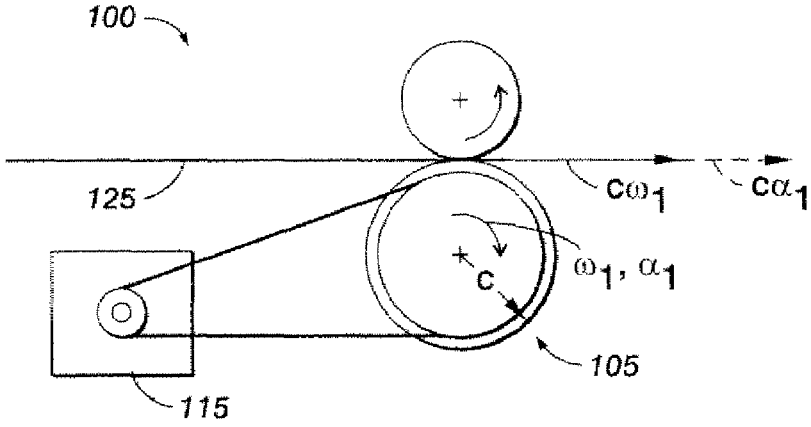
FIG. 1A (PRIOR ART)
FIGS. 1A and 1B depict an exemplary sheet registration device according to the known art.

A closed-loop gain-scheduled feedback control process based on the pseudo-linearized system may have numerous advantages over conventional open-loop control processes, such as the ones described above. For example, the feedback control process may improve accuracy and robustness. The accuracy of open-loop motion planning relies on the creation of accurate sheet velocities at the inboard and outboard nips 105, 110 (i.e., drive rolls). However, error between desired and actual sheet velocities inevitably occurs. Error may be caused by, for example, a discrepancy between the actual sheet velocity and an assumed sheet velocity. Current systems assume that the rotational motion of parts within the device, specifically the drive rolls that contact and impart motion on a sheet being registered, exactly determine the sheet motion. Manufacturing tolerances, nip strain, and slip may create errors in the assumed linear relationship between roller rotation and sheet velocity. Also, finite servo bandwidth may lead to other errors. Even if the sheet velocity is perfectly and precisely measured, tracking error may exist in the presence of noise and disturbances, and as the desired velocity changes.

The proposed closed-loop algorithm based on the pseudo-linearized system may take advantage of sheet position feedback during every sample period to increase the accuracy and robustness of registration. Open-loop motion planning cannot take advantage of sheet position feedback. As such, the open-loop approach may be subject to inescapable sheet velocity errors that lead directly to registration error. In contrast, the closed-loop approach described herein may use feedback to ensure that the control, such as the drive roll velocity or acceleration, automatically adjusts in real-time based on the actual sheet position measured during registration. As such, this approach may be less sensitive to velocity error and servo bandwidth and may be a more robust result.

In addition, current open-loop algorithms may rely on learning based on performance assessment to satisfy performance specifications. Additional sensors may be required to perform the learning process increasing the cost of the registration system. When a novel sheet is introduced, such as, for example, during initialization of a printing machine, when feed trays are changed, and/or when switching between two sheet types, "out of specification" performance may occur for a plurality of sheets while the algorithm converges. In some systems, the out of specification performance may exist for 20 sheets or more. The feedback control approach described herein does not require learning, allowing drive roll errors to be accounted for over time. This may reduce the required number of sensors, and eliminate the algorithm convergence period and associated "out of specification" sheets.

Moreover, the algorithm used to perform the gain-scheduled feedback control based on the pseudo-linearized system, while comparable in complexity to open-loop planning algorithms, may only be determined once and then programmed. As such, the resulting algorithm may be simpler, require less computation and be easier to implement.

Figure 1B:
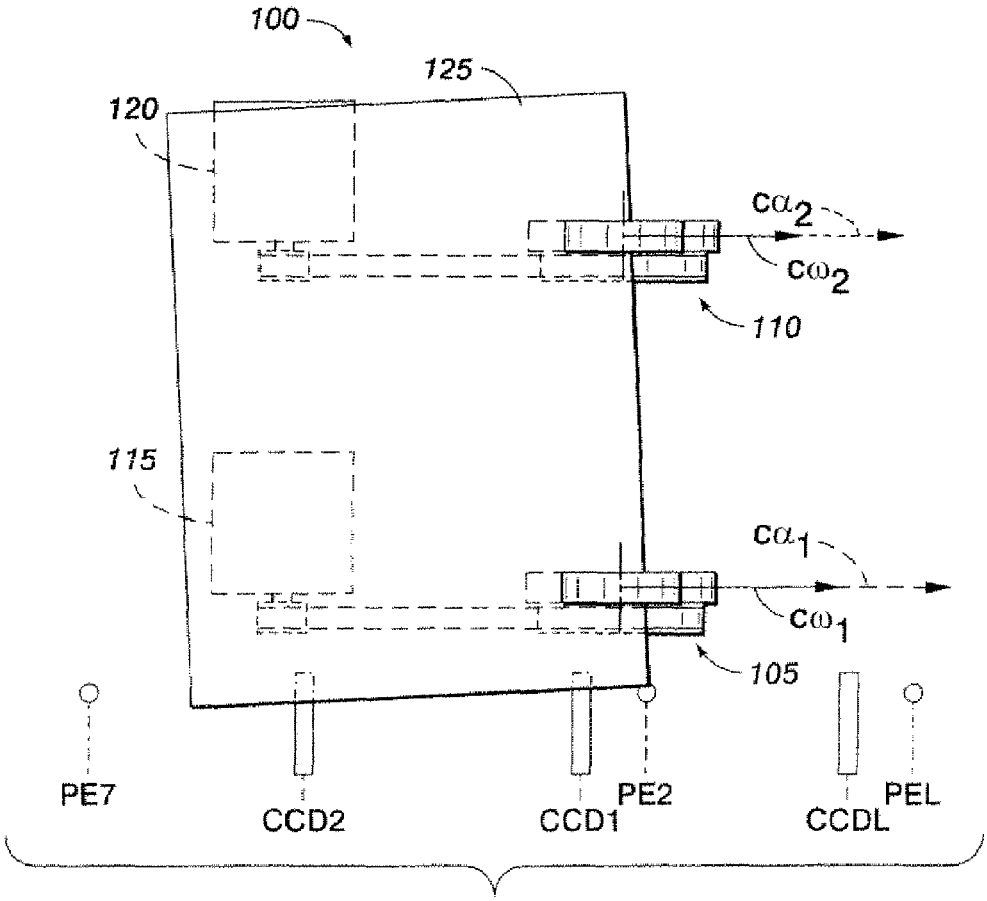
FIG. 1B (PRIOR ART)
Figure 2:
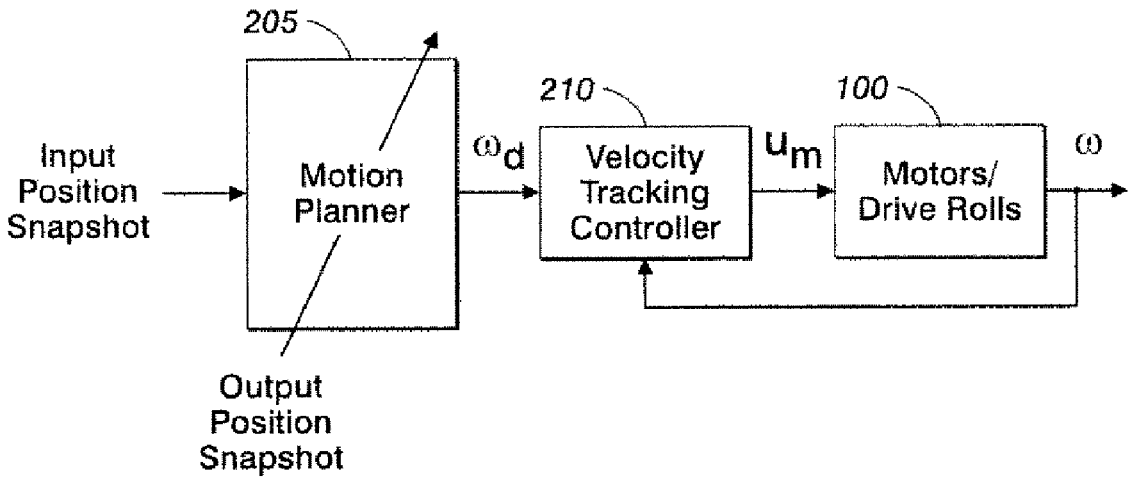
FIG. 2 (PRIOR ART)
FIG. 2 depicts an exemplary open-loop motion planning control process according to the known art.
Figure 3A:
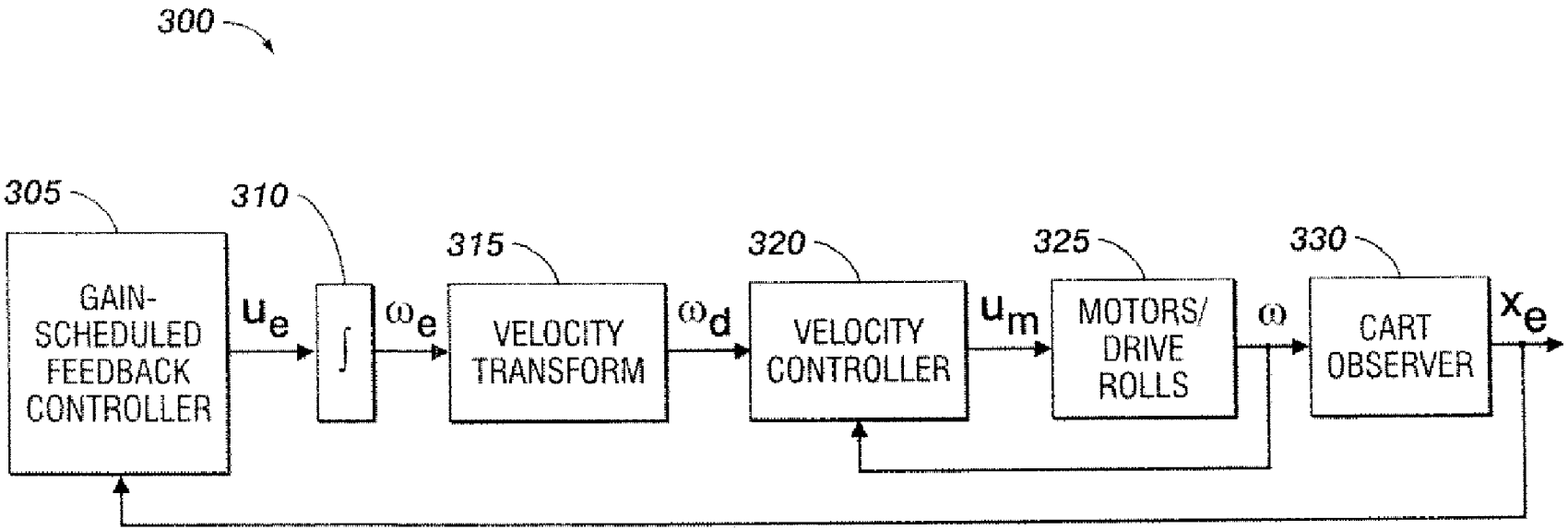
FIGS. 3A and 3B depict exemplary gain-scheduled feedback control processes based on a pseudo-linearized system according to an embodiment.
Figure 3B:
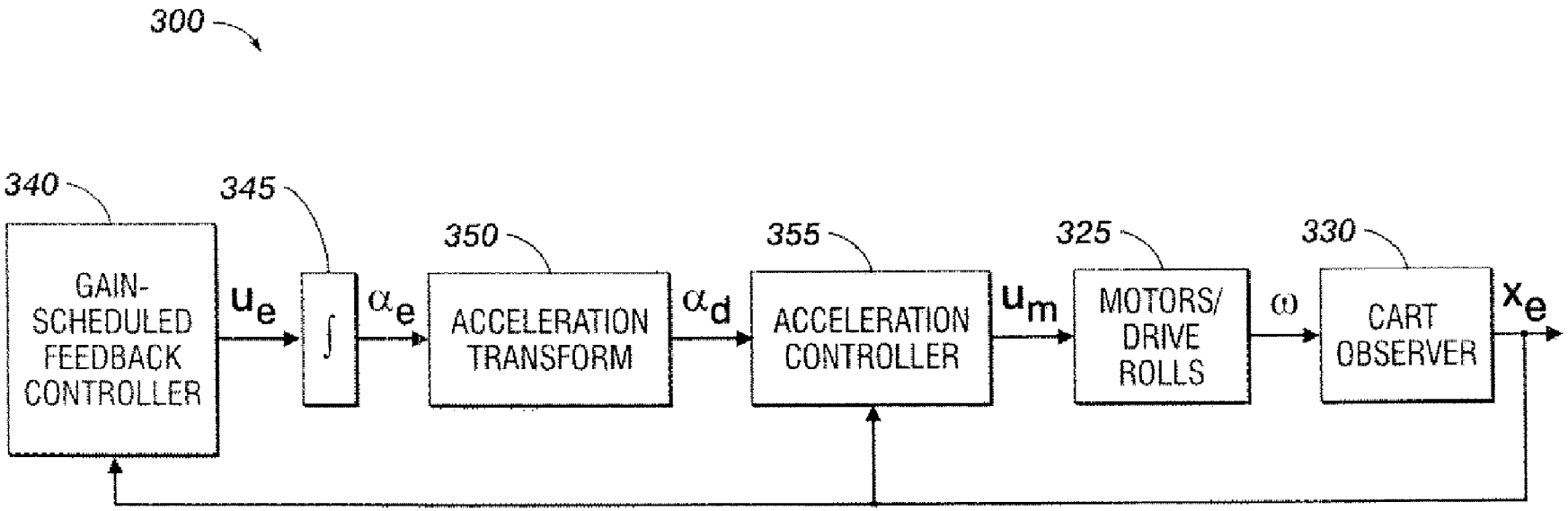

FIGS. 3A and 3B depict exemplary gain-scheduled feedback control processes based on a pseudo-linearized system according to embodiments. Each gain-scheduled feedback control process 300 may use information retrieved from a sheet registration system, such as the system shown in FIGS. 1A and 1B, to register a sheet. Information retrieved from the sensors, such as CCD1, CCD2, CCDL, PE2, PEL and encoders on the roll shafts, may be used to determine a position of a sheet during the registration process. Other sheet registration systems, having more or fewer sensors that are placed in a variety of locations, may be used within the scope of the present disclosure, which is not limited to use with the system shown in FIGS. 1A and 1B.

A reference frame may initially be selected (for example, the reference frame described below in reference to FIG. 4A), and error-space state vector $x_e$ may be selected based on the reference frame. A coordinate system may be constructed within a reference frame (i.e., a perspective from which a system is observed) to analyze the operation of the sheet registration system. For example, the xy reference frame (in FIG. 4A) is fixed to the drive rolls (nips). In contrast, the XY reference frame (in FIG. 4A) is fixed to the sheet.

Finding a controllable pseudo-linearized system on which to base the design of a feedback controller 305 may require the selection of an appropriate reference frame and state variables defined with respect to this frame. FIG. 4A depicts an exemplary xy reference frame fixed to the drive rolls, where the process direction (i.e., the direction that the sheet is intended to be directed) is defined to be the x-axis, and the y-axis is perpendicular to the x-axis in, for example, an inboard direction. Three sheet position state variables may be defined in the basis of this reference frame: $\{x, y, \theta\}$, where $\{x, y\}$ denote the coordinates of the center of mass of the sheet ($P_s$); and $\theta$ denotes the skew of the sheet relative to the x-axis.

Figure 4A:
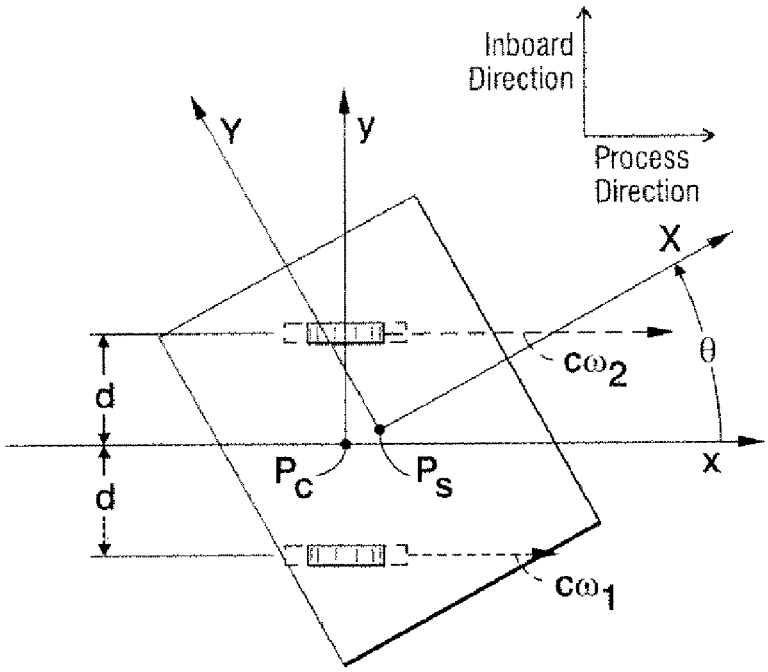
FIG. 4A depicts the reference frames and state variables of a sheet registration system according to an embodiment.

For the feedback control process shown in FIG. 3A, if no slip exists between the drive rolls and the sheet, three kinematic equations may relate the sheet state variables to the angular velocities of the drive rolls:

$$\dot{\theta} = \frac{c(\omega_1 - \omega_2)}{2d}, \dot{x} = \frac{c(\omega_1 - \omega_2)}{2} - y\dot{\theta}, \text{ and } \dot{y} = x\dot{\theta},$$

where:

$\{\omega_1, \omega_2\}$ denote the angular velocities of the outboard and inboard drive rolls, respectively;

c denotes the radius of the drive rolls; and 2d denotes the distance between the rolls as shown in FIG. 4A.

An average surface velocity of the drive rolls and a differential surface velocity of the drive rolls, $\{v, \omega\}$ respectively, may relate to the angular velocities of the drive rolls as follows:

$$v = \frac{c\omega_1 + c\omega_2}{2}, \omega = \frac{c(\omega_1 - \omega_2)}{2d}$$

The three kinematic equations may then be rewritten as:

$$\dot{\theta}=\omega, \dot{x}=v-y\omega, \text{ and } \dot{y}=x\omega.$$

A sheet registration device may seek to make the sheet track a desired straight line path with zero skew at the process velocity. In the basis of the xy reference frame, this desired trajectory is described by:

$$x_d(t)=v_d t+x_{di}, y_d(t)=y_{di}, \text{ and } \theta_d(t)=0,$$

where:

$v_d$ denotes the process velocity; and $\{x_{di}, y_{di}\}$ describes the desired initial position of the center of mass of the sheet.

In an embodiment, values for additional higher order derivatives of position or motion may be determined. For example, an average surface acceleration of the drive rolls and a differential surface acceleration of the drive rolls, $\{a, \alpha\}$, respectively, may be related to the angular accelerations of the drive rolls as follows:

$$a = \frac{c\alpha_1 + c\alpha_2}{2}, \alpha = \frac{c(\alpha_1 - \alpha_2)}{2d}$$

where:

$\{\alpha_1, \alpha_2\}$ denote the angular acceleration of the outboard and inboard drive rolls, respectively;

The kinematic equations of the sheet registration device may represent a nonholonomic and nonlinear system. It may be desirable to pseudo-linearize the sheet registration system because controllability of the pseudo-linearized system associated with the nonlinear system at a stationary point is sufficient to ensure the existence of locally stabilizing feedback. When this condition is satisfied, any linear feedback of the form u=K x that stabilizes the pseudo-linearized system may also locally stabilize the nonlinear system. Other gain algorithms may also be performed within the scope of this disclosure.

Pseudo-linearization may be more effective when the state equation is formulated as a regulation problem in an error-space. One formulation may comprise regulating the error between the position of a sheet and that of an ideal (perfectly registered) reference sheet. Unfortunately, it is at least very difficult and likely impossible to create a controllable pseudo-linearized system based on such a formulation. Accordingly, a different formulation and associated state equation must be determined to provide a pseudo-linearized system that is controllable with linear feedback.

One amenable formulation may include regulating the error between the position of the drive rolls (nips) and reference drive rolls, the position of which correlates to the desired trajectory of the sheet. The creation of a virtual pair of reference drive rolls may require inverting perspective, where the rolls move and the paper is held fixed. This may be valid in the context of kinematics. From this perspective, the drive rolls and a virtual body connecting them may form a two-wheeled driven cart riding along the underside of the sheet. As such, the sheet registration control problem may be solved by regulating the error between the position of a cart system and an ideal reference cart system.

Figure 4B:
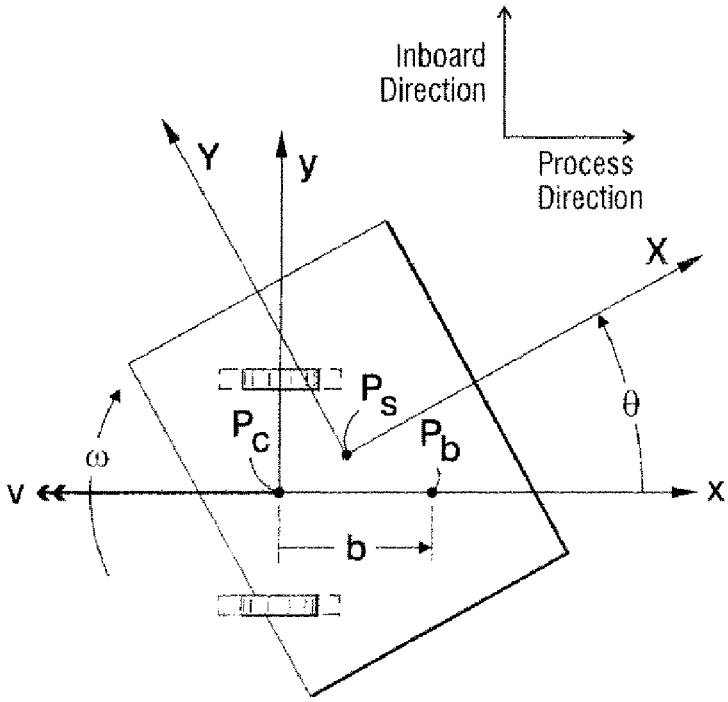
FIG. 4B depicts the reference frames and state variables of a two-wheeled driven cart system riding on the underside of a sheet according to an embodiment.

As illustrated in FIG. 4B, a five dimensional state vector may be defined by a state determination module for the two-wheeled driven cart system with respect to the xy reference frame:

$$x=[x\ y\ \theta\ v\ \omega]^T,$$

where:

- $\{x, y\}$ denote the coordinates of the center of mass of the sheet ($P_s$) relative to the center of the cart ($P_c$);
- $\theta$ denotes the orientation of the sheet relative to the cart (the x axis); and
- $\{v, \omega\}$ denote the linear and angular cart velocities, respectively.

Note that while the linear and angular cart velocities are identical to those for the sheet, the velocities cause the cart to move in the opposite direction of the sheet (as expected) because the cart rides on the underside of the sheet. Furthermore, by using the xy reference frame as opposed to adopting the XY reference frame, the cart position and sheet position state variables are also identical. Although other reference frames may be more intuitive, the described reference frame may provide a formulation amenable to pseudo-linearization.

A similar state vector may be defined for the reference cart system with respect to the xy reference frame:

$$x_r=[x_r\ y_r\ \theta_r\ v_r\ \omega_r]^T,$$

where:

- $\{x_r, y_r\}$ denote the coordinates of the center of the reference cart ($P_c$);
- $\theta_r$ denotes the orientation of the reference cart relative to the x axis; and
- $\{v_r, \omega_r\}$ denote the linear and angular reference cart velocities, respectively.

and $\{x_{br}, y_{br}\}$, respectively. $P_b$ and $P_{br}$ may be used to determine an error-space state feedback vector between the cart and the reference cart. For example, an error-space state feedback vector may be determined at least by the difference between the location of $P_b$ for the controlled cart and the location of $P_{br}$ for the reference cart. The error-space state feedback vector may be defined as follows:

$$x_e=[x_e\ y_e\ \theta_e\ v_e\ \omega_e]^T,$$

where:

$x_e=x_{br}-x_b=x_r+b\cos\theta_e-b$,
$y_e=y_{br}-y_b=y_r+b\sin\theta_e$.
$\theta_e=\theta_r$.
$v_e=v_r-v$, and
$\omega_e=\omega_r-\omega$.

Because the cart system shares the same state variables and associated kinematic equations as the sheet registration system, the desired trajectory may also be shared. Using xy as the reference frame, the reference cart state variables may be related to the cart state variables and the desired cart state variables by the following equations:

$$x_r=x-x_d,$$

$$y_r=y-y_d, \text{ and}$$

$$\theta_r=\theta_e=\theta-\theta_d.$$

If b is set to 0, then $x_e=x_r$ and $y_e=y_r$. As such, $x_e=x-x_d$ and $y_e=y-y_d$. In other words, the error between the cart and the reference cart may be equal and opposite to the error between the cart and its desired trajectory. As such, convergence of the cart to its desired trajectory may yield convergence of the sheet to its desired trajectory.

The derivatives of $x_e$, $y_e$ and $\theta_e$ may be related to the linear and angular cart velocities by the following kinematic equations: $\dot{x}_e=v-v_r\cos\theta_e-y_e\omega+b\omega_r\sin\theta_e$, $\dot{y}_e=-v_r\sin\theta_e+(x_e+b)\omega-b\omega_r\cos\theta_e$, and $\dot{\theta}_e=\omega-\omega_r$. These terms may be regrouped as follows:

$$\dot{x}_e=-\omega_r y_e+\left(b\omega_r\frac{\sin\theta_e}{\theta_e}-v_r\frac{\cos\theta_e-1}{\theta_e}\right)\theta_e-v_e+y_e\omega_e,$$

$$\dot{y}_e=\omega_r x_e+\left(-b\omega_r\frac{\cos\theta_e-1}{\theta_e}-v_r\frac{\sin\theta_e}{\theta_e}\right)\theta_e-(x_e+b)\omega_e, \text{ and}$$

$$\dot{\theta}_e=-\omega_e.$$

Moreover, the resulting state-equation may be expressed in standard nonlinear form, i.e., $dx_e/dt-f_e(x_e, u_e)$, as follows:

$$\frac{d}{dt}\begin{bmatrix} x_e \\ y_e \\ \theta_e \\ v_e \\ \omega_e \end{bmatrix}=\begin{bmatrix} 0 & -\omega_r & \left(b\omega_r\frac{\sin\theta_e}{\theta_e}-v_r\frac{\cos\theta_e-1}{\theta_e}\right) & -1 & y_e \\ \omega_r & 0 & \left(-b\omega_r\frac{\cos\theta_e-1}{\theta_e}-v_r\frac{\sin\theta_e}{\theta_e}\right) & 0 & -(x_e+b) \\ 0 & 0 & 0 & 0 & -1 \\ 0 & 0 & 0 & 0 & 0 \\ 0 & 0 & 0 & 0 & 0 \end{bmatrix}\begin{bmatrix} x_e \\ y_e \\ \theta_e \\ v_e \\ \omega_e \end{bmatrix}+\begin{bmatrix} 0 & 0 \\ 0 & 0 \\ 0 & 0 \\ 1 & 0 \\ 0 & 1 \end{bmatrix}\begin{bmatrix} a_e \\ \alpha_e \end{bmatrix},$$

Figure 5:
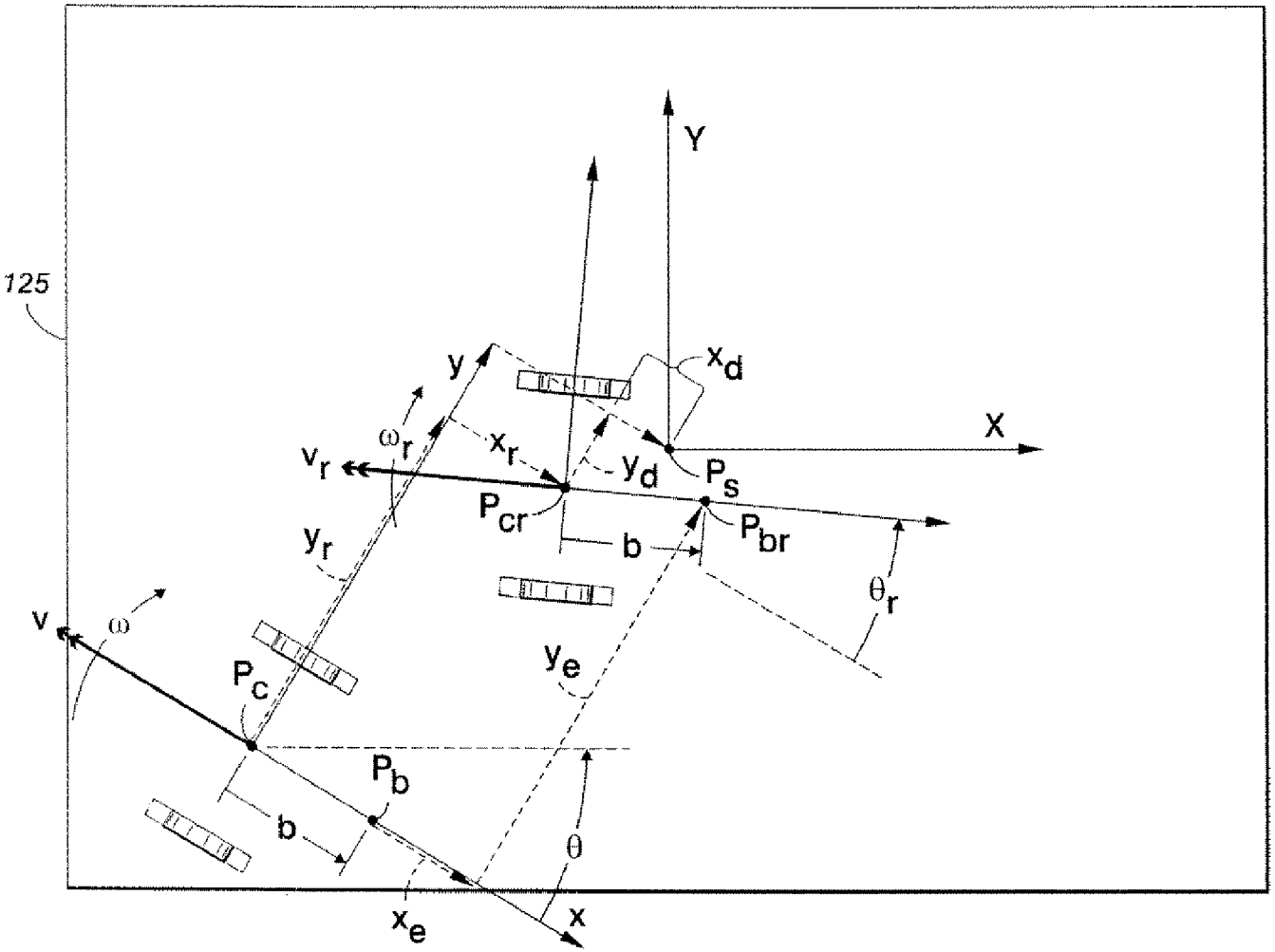
FIG. 5 depicts an exemplary two-wheeled driven cart system and a reference cart system according to an embodiment.

The two-wheeled driven cart and reference cart systems may be illustrated in FIG. 5, described below. For convenience, FIG. 5 may be aligned to the XY frame and depict a large sheet, although the xy coordinate system may be used as the reference frame. Control points $P_b$ and $P_{br}$, at a distance b from the center and along the line of symmetry of the cart and the reference cart, respectively, may be described as $\{x_b, y_b\}$ where: $a_e$ is the error-space linear cart acceleration, and $\alpha_e$ is the error-space angular cart acceleration. $a_e$ and $\alpha_e$ may be assumed, to be control input variables, comprising the input vector $u_e=[a_e\ \alpha_e]^T$.

The state equation of the pseudo-linearized system defined around the ideal configuration ($x_e=[0]$, $u_e=[0]$) may be expressed as:

$$\frac{d}{dt}\begin{bmatrix} x_e \\ y_e \\ \theta_e \\ v_e \\ \omega_e \end{bmatrix} = \begin{bmatrix} 0 & -\omega_r & b\omega_r & -1 & 0 \\ \omega_r & 0 & -v_r & 0 & -b \\ 0 & 0 & 0 & 0 & -1 \\ 0 & 0 & 0 & 0 & 0 \\ 0 & 0 & 0 & 0 & 0 \end{bmatrix}\begin{bmatrix} x_e \\ y_e \\ \theta_e \\ v_e \\ \omega_e \end{bmatrix} + \begin{bmatrix} 0 & 0 \\ 0 & 0 \\ 0 & 0 \\ 1 & 0 \\ 0 & 1 \end{bmatrix}\begin{bmatrix} a_e \\ \alpha_e \end{bmatrix}.$$

If $v_r$ and $\omega_r$ are held constant, the pseudo-linearized system has standard linear time invariant (LTI) state-space form, i.e., $dx_e/dt=A_e\ x_e+B_e\ u_e$. In a sheet registration system, $v_r$ may typically be set to a constant value because the reference sheet is desired to be moved through the system at a constant velocity, and $\omega_r$ may typically be set to 0 because the reference sheet is desired not to rotate.

In alternate embodiments, the control input variables may be based on any other derivative of position, such as velocity, jerk (derivative of acceleration) or a higher order derivative. For example, if the control input variables are based on velocity, the resulting state-equation may be expressed in matrix form as follows:

$$\frac{d}{dt}\begin{bmatrix} x_e \\ y_e \\ \theta_e \end{bmatrix} = \begin{bmatrix} 0 & -\omega_r & \left(b\omega_r\frac{\sin\theta_e}{\theta_e} - v_r\frac{\cos\theta_e - 1}{\theta_e}\right) \\ \omega_r & 0 & \left(b\omega_r\frac{\cos\theta_e - 1}{\theta_e} - v_r\frac{\sin\theta_e}{\theta_e}\right) \\ 0 & 0 & 0 \end{bmatrix}\begin{bmatrix} x_e \\ y_e \\ \theta_e \end{bmatrix} + \begin{bmatrix} -1 & y_e \\ 0 & -(x_e + b) \\ 0 & -1 \end{bmatrix}\begin{bmatrix} v_e \\ \omega_e \end{bmatrix}.$$

Similarly, if the control input variables are based on jerk, the resulting state-equation may be expressed in matrix form as follows:

$$\frac{d}{dt}\begin{bmatrix} x_e \\ y_e \\ \theta_e \\ v_e \\ \omega_e \\ a_e \\ \alpha_e \end{bmatrix} = \begin{bmatrix} 0 & -\omega_r & \left(b\omega_r\frac{\sin\theta_e}{\theta_e} - v_r\frac{\cos\theta_e - 1}{\theta_e}\right) & -1 & y_e & 0 & 0 \\ \omega_r & 0 & \left(-b\omega_r\frac{\cos\theta_e - 1}{\theta_e} - v_r\frac{\sin\theta_e}{\theta_e}\right) & 0 & -(x_e + b) & 0 & 0 \\ 0 & 0 & 0 & 0 & -1 & 0 & 0 \\ 0 & 0 & 0 & 0 & 0 & 1 & 0 \\ 0 & 0 & 0 & 0 & 0 & 0 & 1 \\ 0 & 0 & 0 & 0 & 0 & 0 & 0 \\ 0 & 0 & 0 & 0 & 0 & 0 & 0 \end{bmatrix}\begin{bmatrix} x_e \\ y_e \\ \theta_e \\ v_e \\ \omega_e \\ a_e \\ \alpha_e \end{bmatrix} + \begin{bmatrix} 0 & 0 \\ 0 & 0 \\ 0 & 0 \\ 0 & 0 \\ 0 & 0 \\ 1 & 0 \\ 0 & 1 \end{bmatrix}\begin{bmatrix} j_e \\ \varphi_e \end{bmatrix},$$

where $j_e$ and $\phi_e$ are error-space linear and angular jerks, respectively.

The gain-scheduled feedback controller 305 may receive error-space state feedback values $x_e$ and use the values to determine control input variables $u_e$, such as error-space cart accelerations, for the drive rolls (nips) 105, 110. The error-space state feedback values $x_e$ may be determined based on, for example, the error in the position and the error in the average and differential surface velocities of the drive rolls with respect to a desired trajectory as described above. The error-space state feedback $x_e$ may be determined based on sensor information from, for example, the sensors described above with respect to FIG. 1B or any other sensor configuration that can detect or estimate the position of a sheet. The control input variables $u_e$ may be determined by determining the state feedback gain matrix K, designed based on the pseudo-linearized system, and multiplying the matrix by the error state feedback values $x_e$.

If no system constraints existed, a fixed state-feedback gain matrix K would suffice to control the sheet. However, the period of time to perform sheet registration is limited based on the throughput of the device. In addition, violating maximum tail wag and/or nip force requirements may create image quality defects. Tail wag and nip force refer to effects which may damage or degrade registration of the sheet. For example, excessive tail wag could cause a sheet to strike the side of the paper path. Likewise, if a tangential nip force used to accelerate the sheet exceeds the force of static friction, slipping between the sheet and drive roll will occur.

To satisfy the time constraints for a sheet registration system, high gain values may be desirable. However, to limit the effects of tail wag and nip force below acceptable thresholds, small gain values may be required. Depending on the error of the actual sheet with respect to the reference sheet and machine specifications, a viable solution may not exist if the gain values are fixed.

In order to circumvent such constraints, gain scheduling may be employed to permit adjustment of the gain values during the sheet registration process. Relatively low gain values may be employed at the onset of the registration process in order to satisfy max nip force and tail wag constraints, and relatively higher gain values may be employed towards the end of the process to guarantee timely convergence.

In an embodiment, pole placements may be performed offline at equally spaced intervals along a smooth changing set of desired pole locations in order to attain a set of smoothly changing gain values. The resulting gain values may be regressed onto, for example, a third-order polynomial in time. During registration, an appropriate gain matrix K may then be obtained in real time by evaluating the polynomial. In an embodiment, the parameter b may also be scheduled. However, the value b may have minimal effect on the convergence rate and may be set to 0 accordingly. It will be apparent to one of ordinary skill in the art that the use of a third-order polynomial is merely exemplary. Gain values may be regressed onto a function other than a polynomial or a polynomial having a different order within the scope of the present disclosure. It will be apparent to one of ordinary skill in the art that alternate gain algorithms may be used within the scope of this disclosure.

The desired motion of the drive rolls, such as the angular velocities $\omega_d$ in FIG. 3A or the angular accelerations $\alpha_d$ in FIG. 3B, may be accurately matched by the drive rolls 325. With respect to FIG. 3A, to determine the desired roll velocities $\omega_d$, the control input variables $u_e$ may be integrated using an appropriate number of integrators 310 to determine the error-space velocity values $\omega_e=[v_e\ \omega_e]^T$. For example, if the control input variables $u_e$ comprise error-space acceleration values, the control input variables $u_e$ may be integrated 310 once. Likewise, if the control input variables $u_e$ comprise error-space jerk values, the control input variables $u_e$ may be integrated 310 twice. However, if the control input variables $u_e$ comprise error-space velocity values, no integration 310 may be performed. The error-space velocity values $\omega_e$ may then be transformed into desired roll velocities $\omega_d=[\omega_{d1}\ \omega_{d2}]^T$ by a velocity transform module 315. The combination of the feedback controller 305, the integrators 310 (if any), and the velocity transform module 315 may be termed a drive roll velocity determination module.

The following equations may be used to determine the values for $\omega_d$:

$$\omega_{d1}=\frac{v_r-v_e+d(\omega_r-\omega_e)}{c}\text{ and }\omega_{d2}=\frac{v_r-v_e-d(\omega_r-\omega_e)}{c}.$$

One or more motor controllers 320 may then generate motor control signals $u_m=[u_{m1}\ u_{m2}]^T$ for the motors that drive the drive rolls 325 in order to match $\omega$ to $\omega_d$. The motor control signals $u_m$ may impart an angular velocity at which each corresponding drive roll 325 operates (collectively, $\omega$). For example, a pulse width modulated voltage can be created for a DC brushless servo motor based on $u_{m1}$ to track a velocity $\omega_1$ to a desired velocity $\omega_{d1}$. In an alternate embodiment, any of a stepper motor, an AC servo motor, a DC brash servo motor, and other motors known to those of ordinary skill in the art can be used. As shown in FIG. 3A, each motor controller 320 may comprise a velocity controller. In an embodiment, the motor control signals $u_m$ may impart an angular velocity that is substantially equal to the desired angular velocity for each corresponding drive roll 325 (collectively, $\omega_d$).

With respect to FIG. 3B, to determine the desired roll accelerations $\alpha_d$, the control input variables $u_e$ may be integrated using an appropriate number of integrators 310 to determine the error-space acceleration values $\alpha_e=[a_e\ \alpha_e]^T$. For example, if the control input variables $u_e$ comprise error-space jerk values, the control input variables $u_e$ may be integrated 310 once. However, if the control input variables $u_e$ comprise error-space acceleration values, no integration 310 may be performed. The error-space acceleration values $\alpha_e$ may then be transformed into desired roll accelerations $\alpha_d=[\alpha_{d1}\ \alpha_{d2}]^T$ by an acceleration transform module 340. The combination of the feedback controller 305, the integrators 310 (if any), and the acceleration transform module 340 may be termed a drive roll acceleration determination module.

The following equations may be used to determine the values for $\alpha_d$:

$$\alpha_{d1}=\frac{a_r-a_e+d(\alpha_r-\alpha_e)}{c}\text{ and }\alpha_{d2}=\frac{a_r-a_e-d(\alpha_r-\alpha_e)}{c}.$$

One or more motor controllers 320 may then generate motor control signals $u_m=[u_{m1}\ u_{m2}]^T$ for the motors that drive the drive rolls 325 in order to match $\alpha$ to $\alpha_d$. The motor control signals $u_m$ may determine the angular acceleration at which each corresponding drive roll 325 operates (collectively, $\alpha$). For example, a current can be created for a servo motor based on $u_{m1}$, which itself may be based on a model of the system dynamics, to create the appropriate torque to match an acceleration $a_1$ to a desired velocity $a_{d1}$. As shown in FIG. 3B, each motor controller 320 may comprise an acceleration controller. In an embodiment, the motor control signals $u_m$ may impart an angular acceleration that is substantially equal to the desired angular velocity for each corresponding drive roll 325 (collectively, $\alpha_d$).

An observer module 330 may convert the measured roll velocities $\omega$ into error-space cart velocities based on the following equations:

$$v_e=v_r-\frac{c(\omega_1+\omega_2)}{2}\text{ and }\omega_e=\omega_r-\frac{c(\omega_1-\omega_2)}{2d}.$$

The individual equations within the error-space state equation—

$$\begin{aligned}\dot{\theta}_e&=-\omega_e,\ \dot{x}_e\\&=-\omega_r y_e+\left(b\omega_r\frac{\sin\theta_e}{\theta_e}-v_r\frac{\cos\theta_e-1}{\theta_e}\right)\theta_e-v_e+y_e\omega_e,\text{ and}\\\dot{y}_e&=\omega_r x_e+\left(-b\omega_r\frac{\cos\theta_e-1}{\theta_e}-v_r\frac{\sin\theta_e}{\theta_e}\right)\theta_e-(x_e+b)\omega_e\end{aligned}$$

—may be employed to evolve the cart position based on the measured roll velocities. The error-space state vector may then be determined based on these values.

The observer module 330 may be initialized by an input sheet position snapshot provided by the sensors. In an embodiment, the snapshot may provide an initial value of the sheet position state variables $\{x_i, y_i, \theta_i\}$, which may also be the initial cart position state variables. The snapshot may be combined with the desired state variables and the equations that relate the desired, reference and error-space state variables to provide the initial value of the cart error-space state variables:

$$x_{ei}=x_i-x_{di}+b\cos\theta_{ri}-b,$$

$$y_{ei}=y_i-y_{di}+b\sin\theta_{ri},\text{ and}$$

$$\theta_{ei}=\theta_i-\theta_{di},$$

where the subscript i represents an initial value.

It may be assumed that $v_{ei}=0$ and $\omega_{ei}=0$ because the sheet arrives at the process velocity and there is no differential velocity until sheet registration begins in a sheet registration process. In the above equations, if b is set to 0, the initial error-states reduce to:

$$x_{ei}=x_i-x_{di},\ y_{ei}=y_i-y_{di},\text{ and }\theta_{ei}=\theta_i-\theta_{di}.$$

In an embodiment, the desired drive roll characteristics, such as the desired velocities, may be fed back in place of the measured values although the measured roll velocities $\{v_e, \omega_e\}$ are used to evolve the positional error states $\{x_e, y_e, \theta_e\}$. In such an embodiment, the feedback noise may be significantly reduced and algorithmic performance may be improved.

In an embodiment, a device capable of performing the above operations may operate as a printing device. The printing device may apply a print element to the sheet in order to perform a printing operation, such as printing information on the sheet. In an embodiment, the print element may perform a xerographic printing operation.

Example

An exemplary sheet registration system designed according to an embodiment was installed in a Xerox iGen3® print engine. The input velocity of the sheets into the drive rolls was approximately 1.025 m/s. The registration was performed at a process velocity of approximately 1.025 m/s, which correlates to approximately 200 pages per minute. This process velocity reduces to a registration time of approximately 0.145 seconds, which is the time in which the feedback controller must converge in order to function properly.

Figure 6:
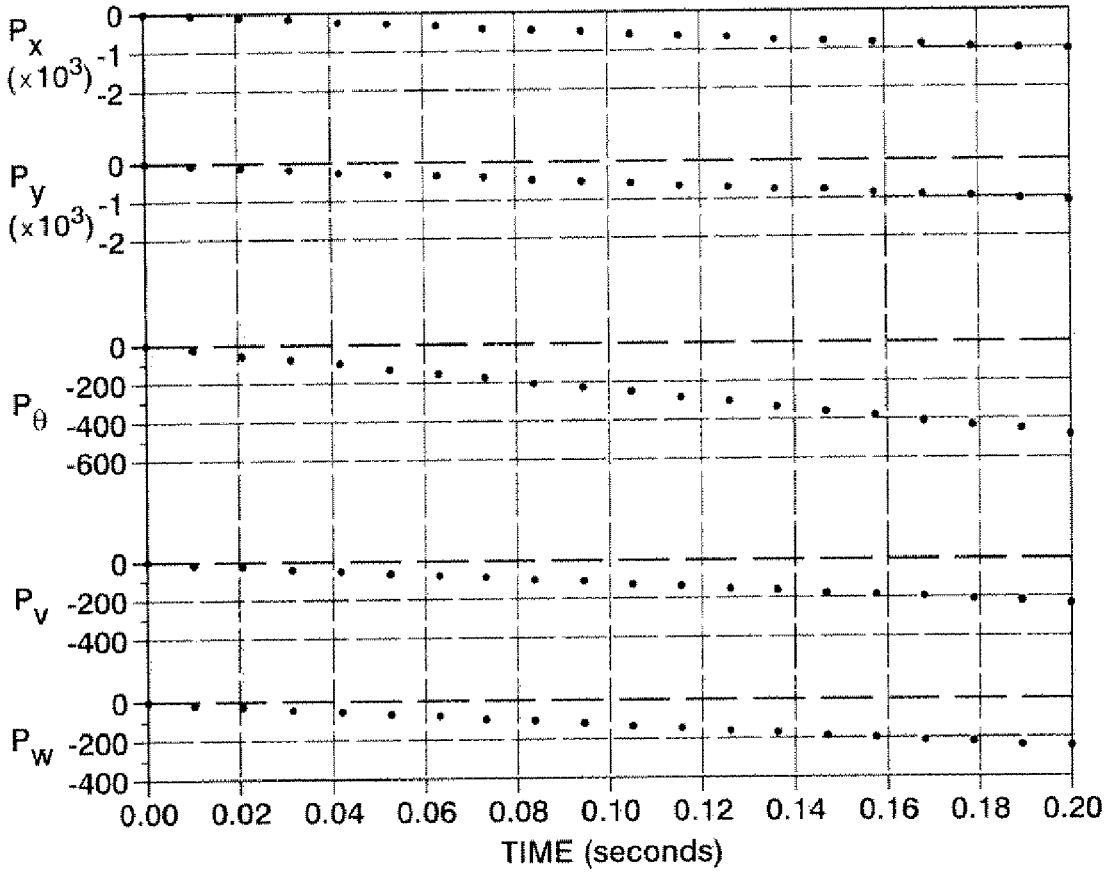
FIG. 6 depicts graphs of a discrete set of pole placements for each of five cart error-space state feedback variables in an exemplary embodiment.
Figure 7:
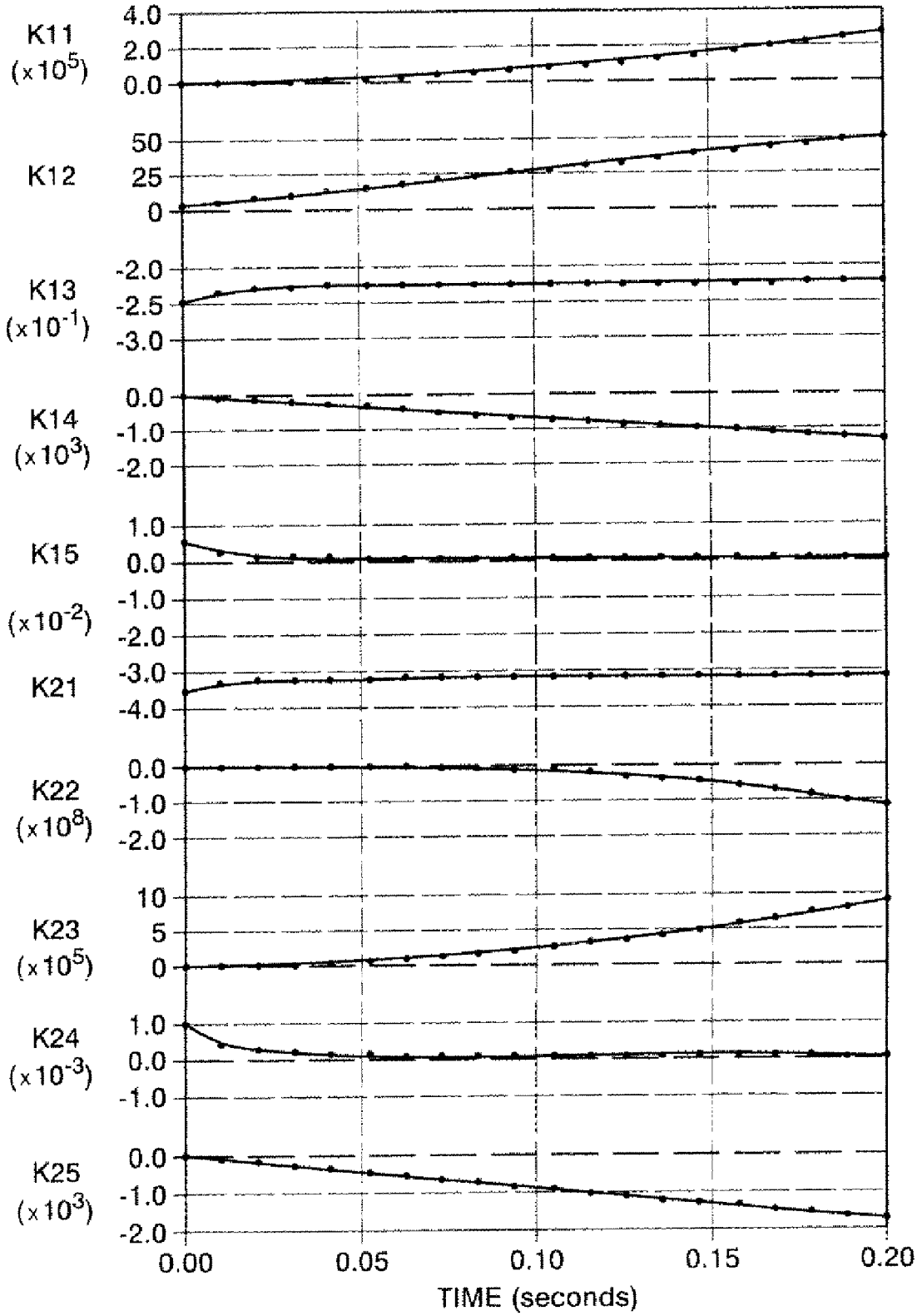
FIG. 7 depicts graphs of the gain values corresponding to the poles of FIG. 6 and a third-order polynomial fit that is used to schedule gain during the sheet registration process in an exemplary embodiment.

The sheet feeding mechanism was adjusted to produce approximately 5 mm of input lateral error. FIG. 6 depicts graphs of a discrete set of pole placements for each of five cart error-space state variables in the exemplary embodiment. FIG. 7 depicts graphs of the gain values corresponding to the poles of FIG. 6 and a third-order polynomial fit that is used to schedule gain during the sheet registration process in the exemplary embodiment. The ten gain values may be identified by their location within the state feedback gain matrix K.

Figure 8:
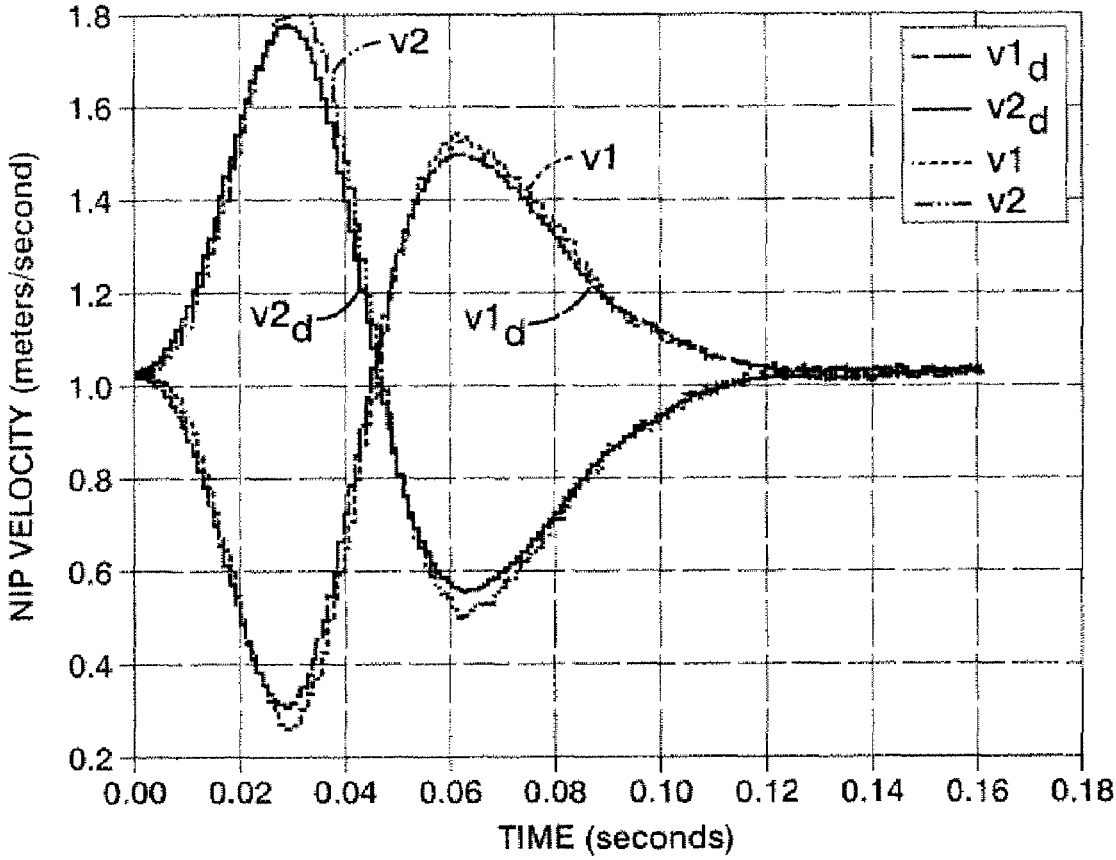
FIG. 8 depicts a graph of the actual nip velocities as produced by the velocity controller and the desired values in an exemplary embodiment.

FIG. 8 depicts a graph of the actual nip velocities as produced by the velocity controller and the desired values in the exemplary embodiment. As shown in FIG. 8, the actual nip velocities and the desired nip velocities produced by the sheet registration system were substantially the same.

Figure 9:
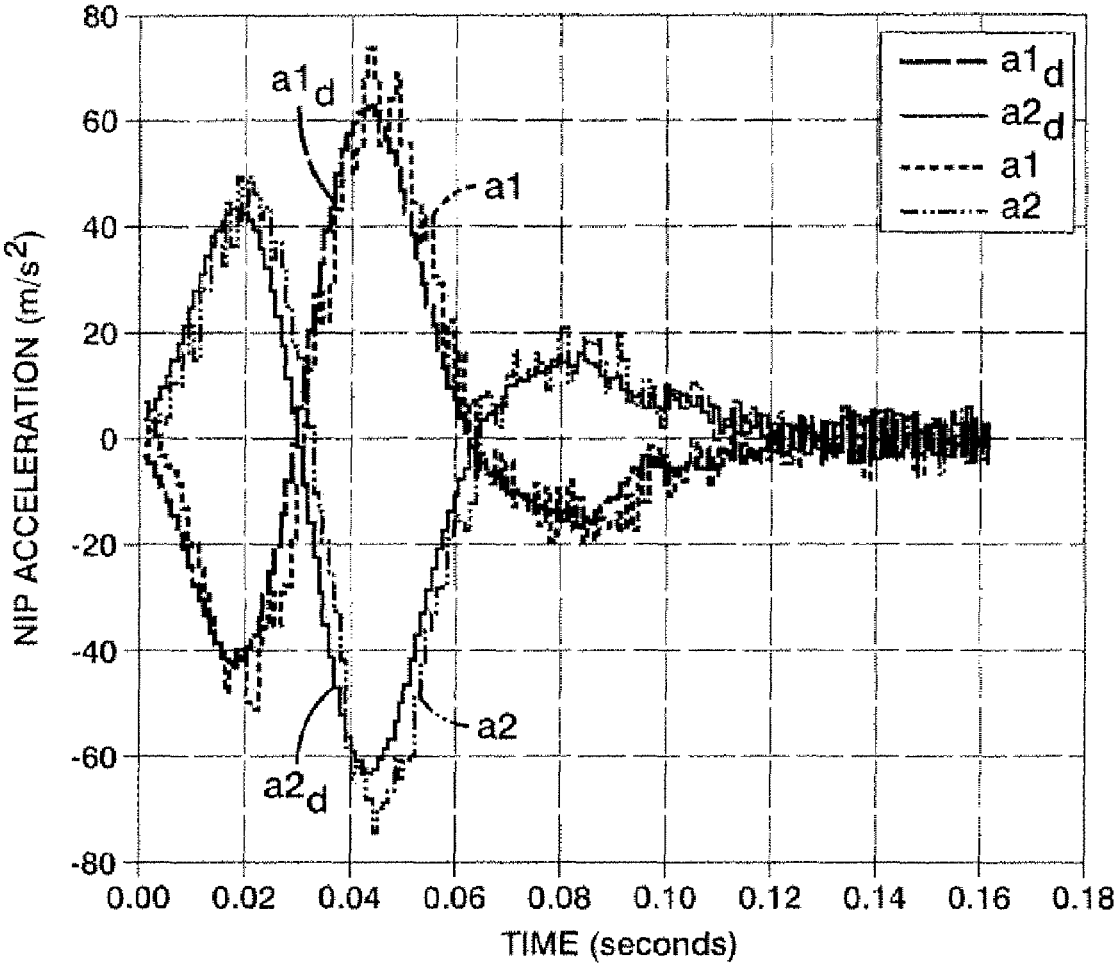
FIG. 9 depicts a graph of the actual nip accelerations as produced by the velocity controller and their desired values in an exemplary embodiment.
Figure 10:
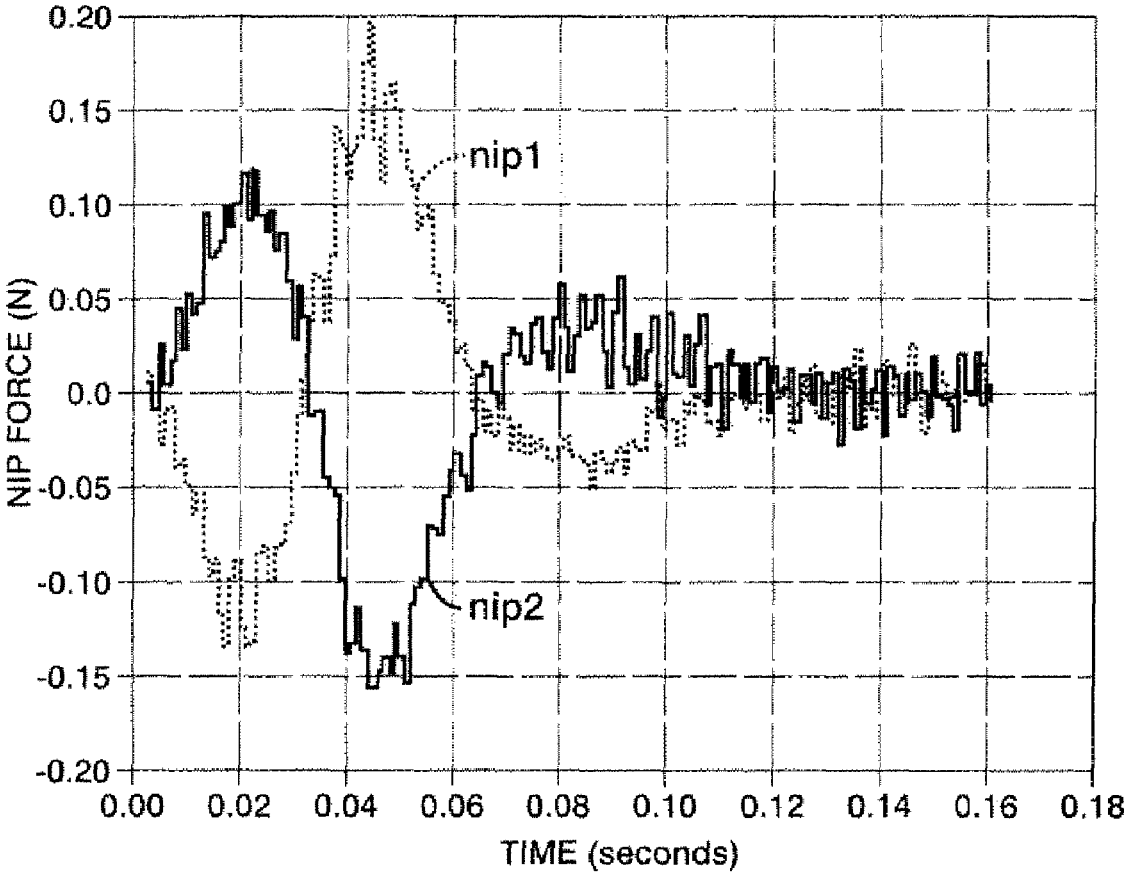
FIG. 10 depicts a graph of the tangential nip forces for each nip in an exemplary embodiment.

FIG. 9 depicts a graph of the nip accelerations as produced by the velocity controller and their desired values in the exemplary embodiment. FIG. 10 depicts a graph of the tangential nip forces for each nip in the exemplary embodiment. Each of the nip accelerations and the tangential nip forces were filtered via a moving average filter to reduce the noise in the plot. As shown, in FIGS. 9 and 10, the desired accelerations and forces closely matched the actual accelerations and forces for the sheet registration system.

Figure 11A:
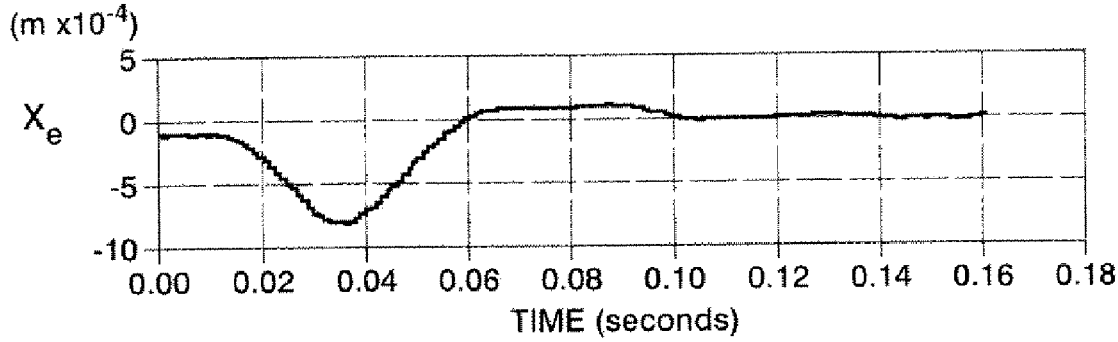
FIGS. 11A-C depict graphs of the error-space state feedback variables for the virtual two-wheeled driven cart system in an exemplary embodiment.
Figure 11B:
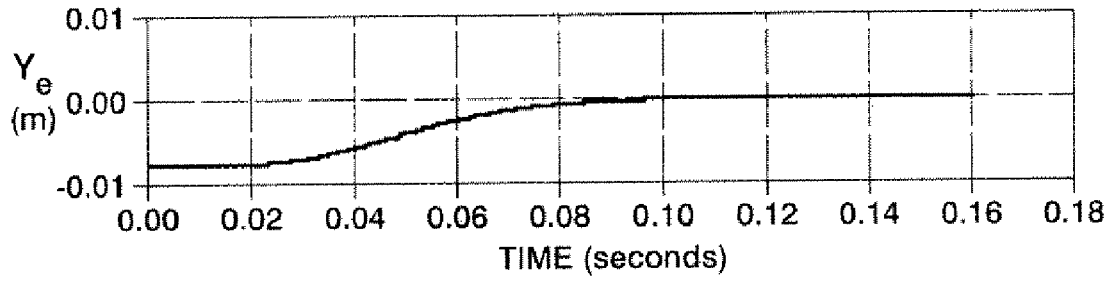
Figure 11C:
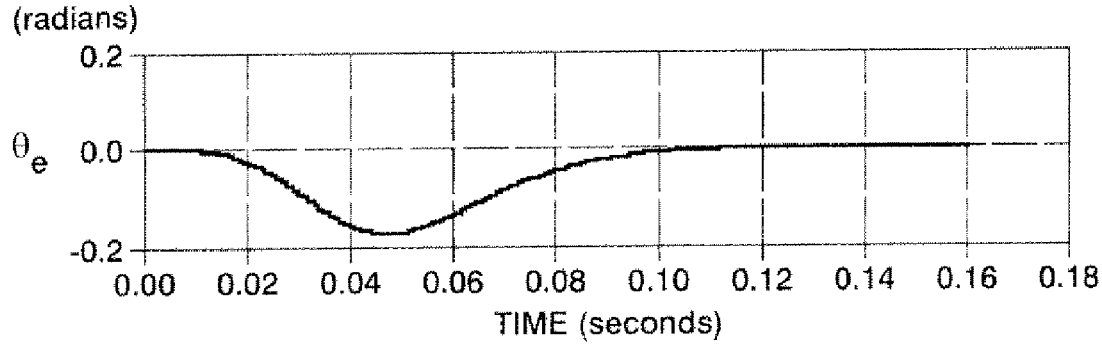
Figure 12A:
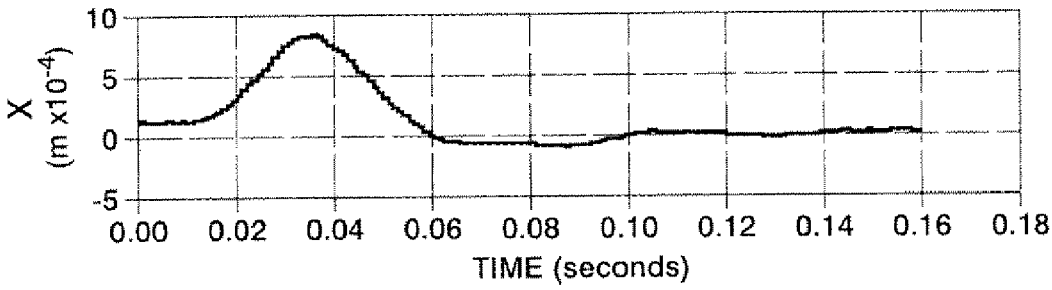
FIGS. 12A-C depict graphs of the error for the x, y and θ sheet position state variables in an exemplary embodiment.
Figure 12B:
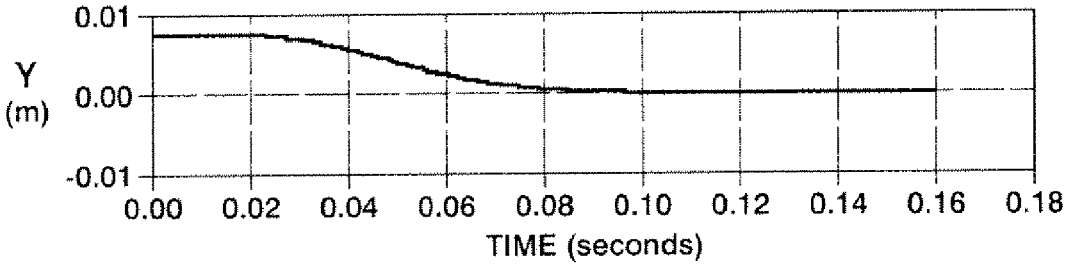
Figure 12C:
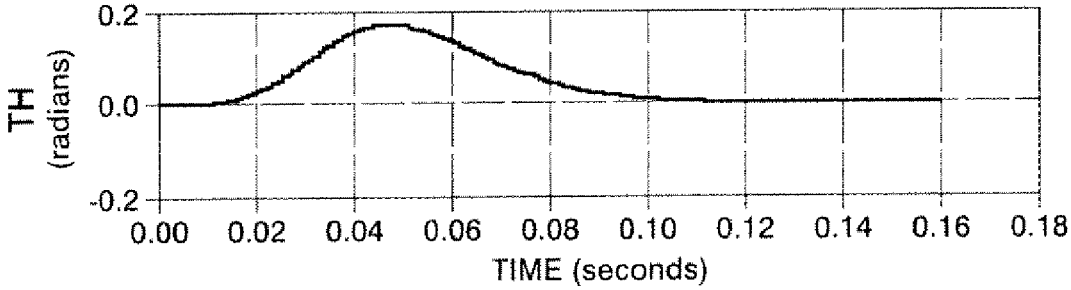

FIG. 11 depicts a graph of the error-space state variables for the virtual two-wheeled driven cart system in the exemplary embodiment. As shown in FIG. 11, the cart outputs asymptotically converged to the desired values via the sheet registration process. Moreover, this convergence occurred within approximately 110 ms, which is substantially less than the 145 ms limit based on the system constraints. The convergence of the cart outputs may guarantee the convergence of the cart states as depicted in FIG. 12, which depicts graphs of the error for the x, y and θ state variables for the cart, respectively, in the exemplary embodiment.

Figure 13:
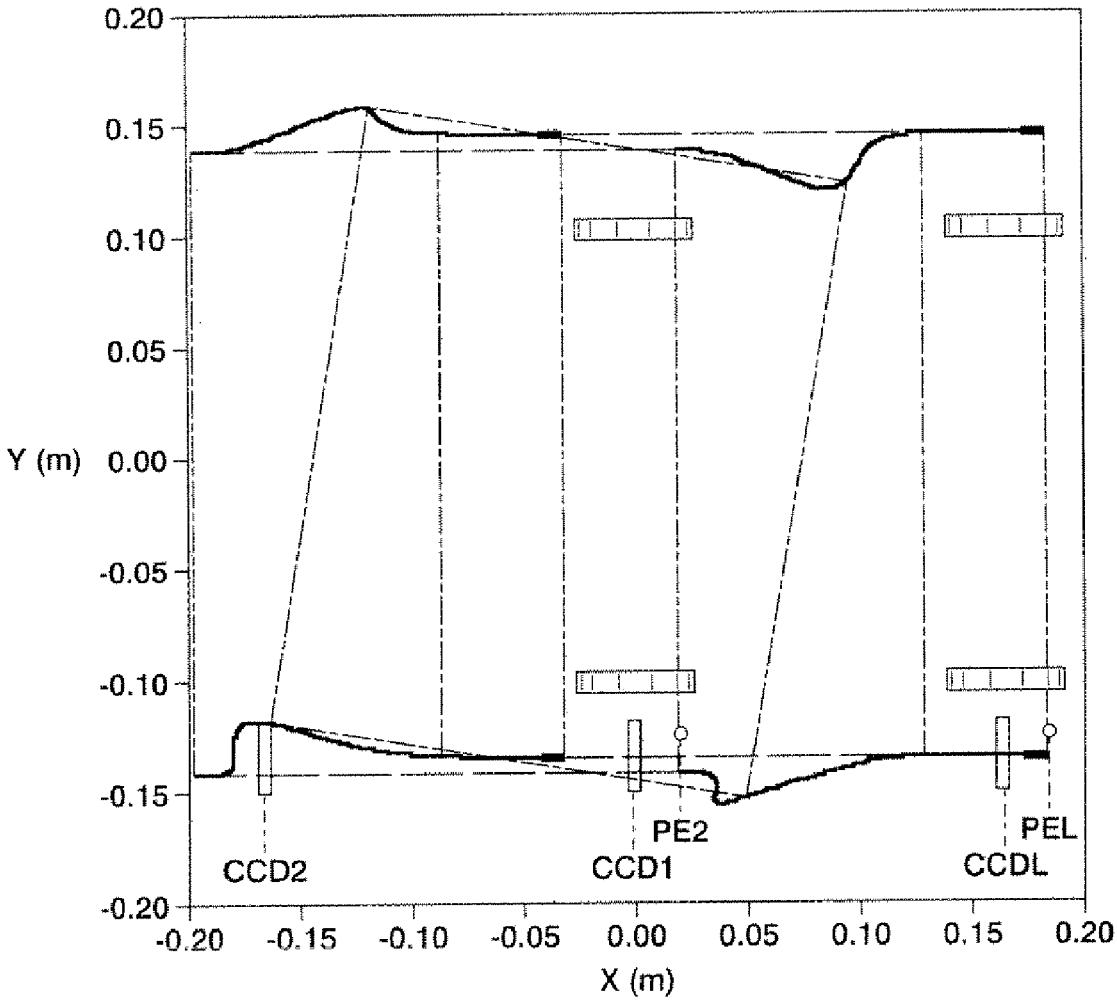
FIG. 13 depicts the sheet position as it moves through the sheet registration system in an exemplary embodiment.

FIG. 13 depicts the sheet position as it moves through the sheet registration system in the exemplary embodiment. As shown in FIG. 13, the sheet's corners were determined based on the observer and plotted as the sheet passes through the sheet registration system (from left to right). FIG. 13 depicts the outline of the sheet for four sample periods during the registration process. The first sample period is the input sheet position snapshot. The CCD sensors, the process edge (PE) sensors and the drive rolls are included in FIG. 13 to provide a frame of reference for the sheet position. The next set of drive rolls are also included to show that the sheet is registered before entering the next nips.

Figure 14A:
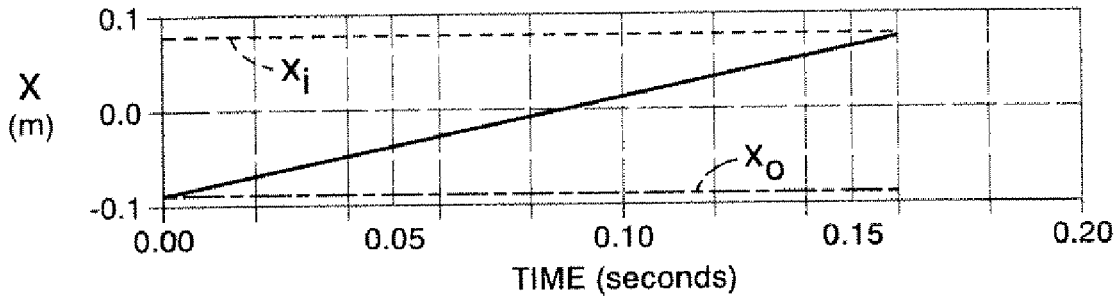
FIGS. 14A-C depict the observed sheet state variables as compared with the input and output sheet position snapshots in an exemplary embodiment.
Figure 14B:
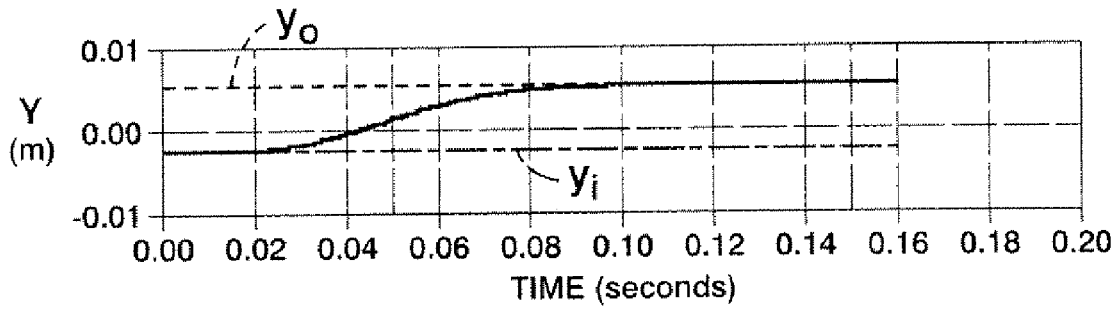
Figure 14C:
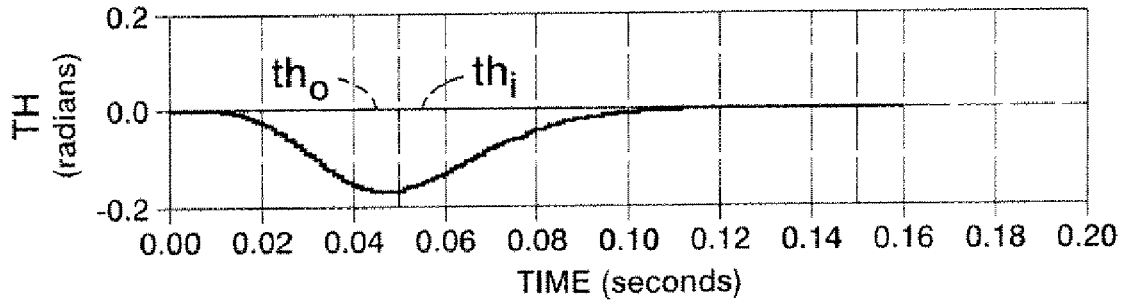

FIG. 14 depicts the observed sheet state variables as compared with the input and output sheet position snapshots in the exemplary embodiment. The input sheet position snapshot may initialize the observer. Accordingly, no error exists at the start. The position of the cart may then be estimated by the observer via the encoders on the drive rolls. The accumulation of error may be summarized by the difference between the observed sheet position state variables and the output sheet position snapshot at the end of registration.

Figure 15:
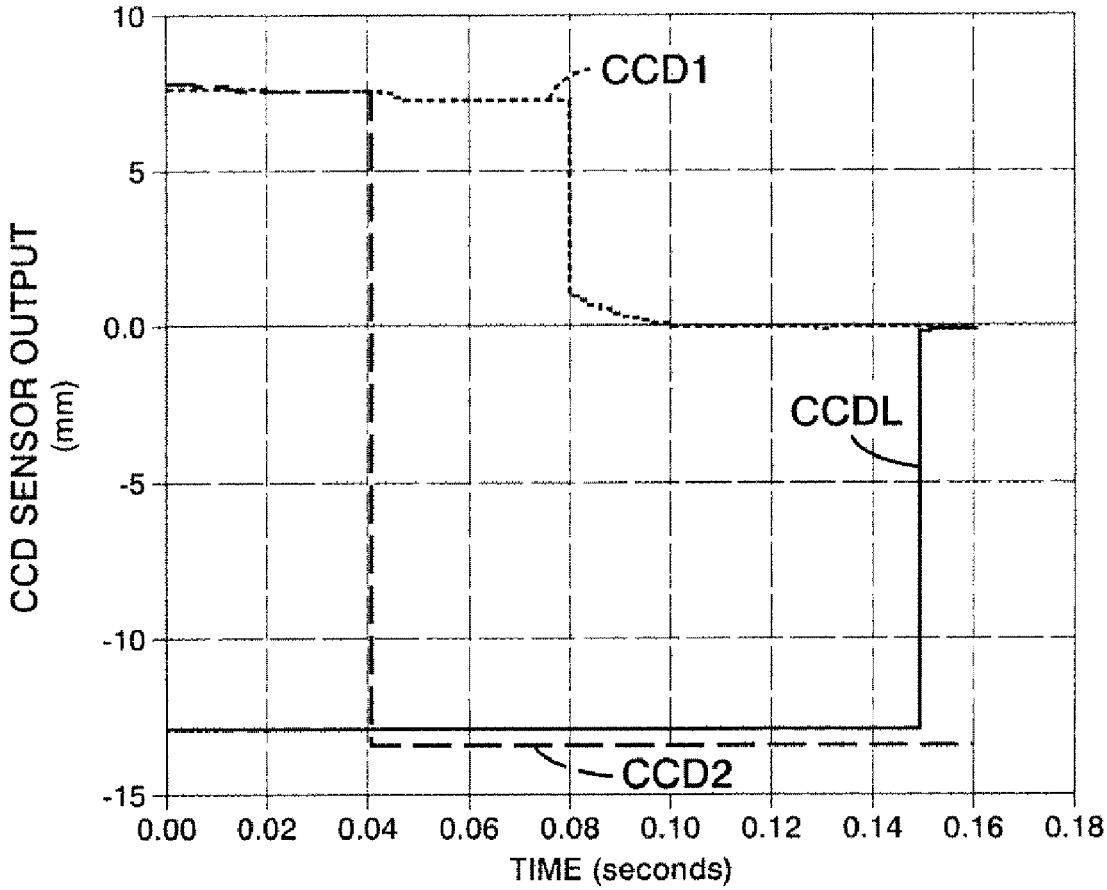
FIG. 15 may show the CCD (lateral edge sensor) readings during the sheet registration process in an exemplary embodiment.

FIG. 15 may show the CCD (lateral edge sensor) readings during the sheet registration process. A zero CCD reading indicates a desired (i.e., perfectly registered) location of the lateral edge of the sheet. Rising edges in FIG. 15 indicate sheet arrival, and falling edges indicate sheet departure. CCD1 and CCD2 are used for the input snapshot and CCD1 and CCDL are used for the output snapshot. Separation of CCD readings may result from sheet skew (i.e., θ error).

The numerical results for the sheet state error are depicted in Table 1.

TABLE 1

Sheet State Error Results

| | $x - x_d$ | $y - y_d$ | $\theta - \theta_d$ |
|---|---|---|---|
| Input state error | −0.111713 mm | −7.685013 mm | 0.932768 mrad |
| Output state error (observed) | 0.002134 mm | −0.000009 mm | 0.122309 mrad |
| Output state error (actual) | −0.312800 mm | 0.112000 mm | −0.254391 mrad |

It will be appreciated that various of the above-disclosed and other features and functions, or alternatives thereof, may be desirably combined into many other different systems or applications. It will also be appreciated that various presently unforeseen or unanticipated alternatives, modifications, variations or improvements therein may be subsequently made by those skilled in the art which are also intended to be encompassed by the disclosed embodiments.

What is claimed is:

1. A method of performing sheet registration, the method comprising:

receiving a sheet by a device having a plurality of drive rolls, wherein each drive roll operates with an associated angular velocity;

identifying a state vector, wherein the state vector comprises a plurality of state variables;

determining error-space state feedback values based on a difference between each state variable and a corresponding reference state variable based on a desired sheet trajectory;

determining control input variable values based on the error-space state feedback values and one or more gains, wherein the one or more gains are based on pseudo-linearized error space state equations;

determining a motor control signal for a motor for each drive roll based on the control input variable values and the state variables, wherein each motor control signal imparts a desired angular velocity value for at least one drive roll; and performing the identifying step and each determining step a plurality of times whereby the sheet is registered to the desired trajectory.

2. The method of claim 1 wherein determining a motor control signal comprises:

integrating the control input variable values an appropriate number of times to produce error-space velocity values, wherein the appropriate number of times is at least one;

transforming the error-space velocity values to desired angular velocity values for each drive roll; and determining a motor control signal to impart the desired angular velocity values to the drive rolls.

3. The method of claim 1 wherein determining control input variable values comprises, for each control input variable value:

evaluating a gain algorithm for at least one gain for at least one error-space state feedback value to determine a gain value;

multiplying at least one error-space state feedback value by a corresponding gain value to determine an intermediate value; and summing each intermediate value to determine the control input variable value.

4. The method of claim 1 wherein the control input variable values are further determined based on one or more of the following constraints:

a maximum force to be applied to the sheet by a drive roll;

a maximum rotational velocity to apply to the sheet; and a maximum sheet registration time.

5. The method of claim 1 wherein the control input variable values comprise a linear component and an angular component.

6. The method of claim 1 wherein the device comprises a printing device and wherein the sheet comprises material onto which the printing device is capable of applying a print element.

7. The method of claim 1 wherein the state variables comprise:

coordinates of a point on the sheet with respect to a reference frame;

a skew of the sheet with respect to the reference frame;

an average surface velocity of the drive rolls; and a differential surface velocity of the drive rolls.

8. The method of claim 7 wherein the state variables further comprise:

an average surface acceleration of the drive rolls; and a differential surface acceleration of the drive rolls.

9. The method of claim 7 wherein the reference frame is fixed to the drive rolls.

10. A system for performing sheet registration, the system comprising:

one or more sensors;

a plurality of drive rolls;

a plurality of motors, wherein each motor is associated with at least one drive roll; and a processor, wherein the processor comprises:

a state determination module for identifying a state vector for a sheet, wherein the state vector comprises a plurality of state variables, wherein the state determination module identifies the plurality of state variables a plurality of times for the sheet, an observer module for determining error-space state feedback values based on a difference between each state variable and a corresponding reference state variable based on a desired sheet trajectory, a drive roll velocity determination module for determining desired velocity values for each drive roll based on the error-space state feedback values and one or more gain values, wherein the one or more gain values are based on pseudo-linearized error space state equations, and a motor controller for determining a motor control signal for each motor, wherein each motor control signal imparts a desired angular velocity value for at least one drive roll, wherein the processor is configured to perform the operations of the state determination module, the observer module, the drive roll velocity determination module, and the motor controller a plurality of times for a sheet, whereby the sheet is registered to the desired sheet trajectory.

11. The system of claim 10 wherein the drive roll velocity determination module comprises:

a gain-scheduled feedback controller for determining control input variable values based on one or more error-space state feedback values and one or more gains;

an integrator for integrating the control input variable values an appropriate number of times based on the selected control input variables to produce error-space velocity values, wherein the appropriate number of times is at least one; and a velocity transform module for transforming the error-space velocity values into the desired angular velocity value for each drive roll.

12. The system of claim 10 wherein, in the gain-scheduled feedback controller, determining control input variable values comprises, for each control input variable value:

evaluating a gain algorithm for at least one gain for at least one error-space state feedback value to determine a gain value;

multiplying at least one error-space state feedback value by a corresponding gain value to determine an intermediate value; and summing each intermediate value to determine the control input variable value.

13. The system of claim 10 wherein the control input variable values are further determined based on one or more of the following constraints:

a maximum force to be applied to the sheet by a drive roll;

a maximum rotational velocity to apply to the sheet; and a maximum sheet registration time.

14. The system of claim 10 wherein the control input variables comprise a linear component and an angular component.

15. The system of claim 10, further comprising:

a print element for printing information on the sheet.

16. The system of claim 10 wherein the state variables comprise:

coordinates of a point on the sheet with respect to a reference frame;

a skew of the sheet with respect to the reference frame;

an average surface velocity of the drive rolls; and a differential surface velocity of the drive rolls.

17. The system of claim 16 wherein the state variables further comprise:

an average surface acceleration of the drive rolls; and a differential surface acceleration of the drive rolls.

18. The system of claim 16 wherein the reference frame is fixed to the drive rolls.

* * * * *